United States Patent [19]

Larsson

[11] 4,279,397

[45] Jul. 21, 1981

[54] ATTACHMENT FOR WALL CABINETS, MIRRORS, SHELVES AND SIMILAR ARTICLES

[75] Inventor: Frank Larsson, Halmstad, Sweden

[73] Assignee: Hafa Fabriks AB, Halmstad, Sweden

[21] Appl. No.: 68,975

[22] Filed: Aug. 23, 1979

[30] Foreign Application Priority Data

Aug. 28, 1978 [SE] Sweden ..... 7809081

[51] Int. Cl.[3] ..... A47B 96/06; A47B 55/00

[52] U.S. Cl. ..... 248/221.3; 108/152; 248/544; 312/245

[58] Field of Search ..... 312/245, 246, 304, 139 R; 248/544, 456, 466, 221.3; 108/152, 134; 52/38, 127

[56] References Cited

U.S. PATENT DOCUMENTS

| | | | |
|---|---|---|---|
| 2,864,578 | 12/1958 | Margulis | 248/221.3 |
| 3,368,856 | 2/1968 | Tisdall et al. | 108/91 |
| 3,381,636 | 5/1968 | Saiberlich | 108/152 |
| 3,636,669 | 1/1972 | Attkisson | 52/38 |
| 3,853,292 | 12/1974 | Junk | 312/245 X |
| 3,953,093 | 4/1976 | Hero | 312/257 A |
| 4,044,813 | 8/1977 | Emmons | 248/466 |

FOREIGN PATENT DOCUMENTS

| | | | |
|---|---|---|---|
| 1288292 | 1/1969 | Fed. Rep. of Germany | 312/245 |
| 2402623 | 7/1975 | Fed. Rep. of Germany | 248/221.3 |

*Primary Examiner*—James T. McCall

*Attorney, Agent, or Firm*—Harness, Dickey & Pierce

[57] ABSTRACT

An attachment device particularly designed to support cabinets, mirrors, shelves and similar elements which are removably mounted on at least two strips arranged horizontally on the wall in parallel and opposite relationship. Means on the strips cooperate with matching means on the element or on members which may be connected to the element. A tongue on the element or the connecting members may be inserted in a groove in one, of the strips or vice versa. The other strip is provided with a groove and the element or connecting members, for cooperation with the latter strip, is provided with grooves or controllable snap means, said grooves or snap means assuming a position opposite the groove and close to the latter when the element is applied against the wall. A number of elements can be mounted along the strips and be secured in the desired position by allowing the snap means to slide into the groove in the other strip.

6 Claims, 11 Drawing Figures

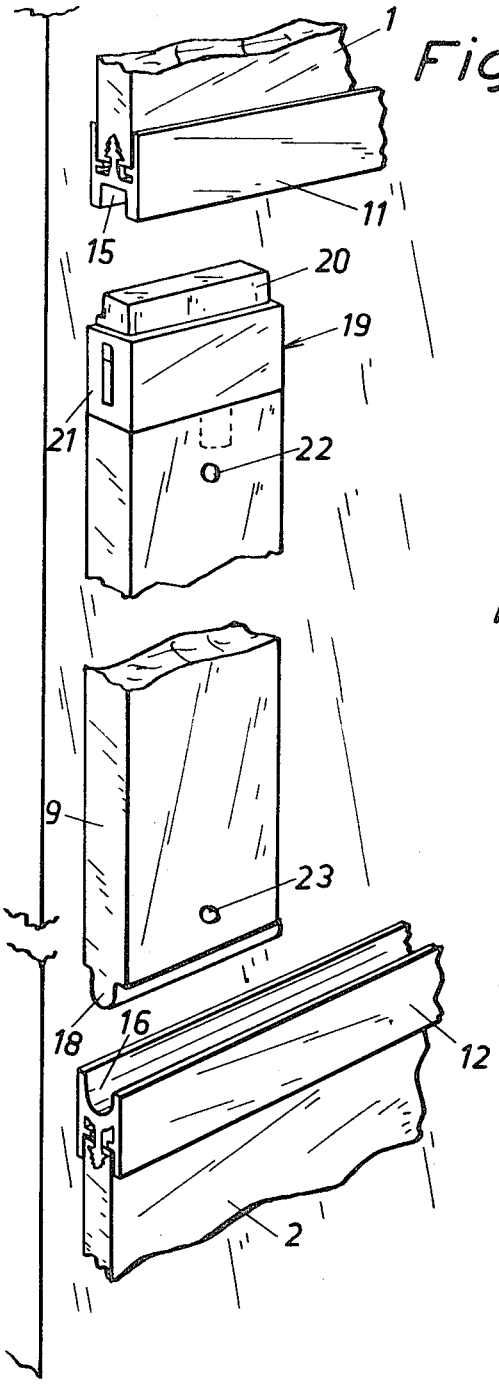
Fig.4
Fig.5
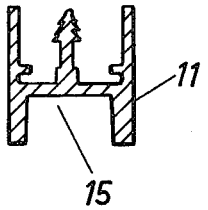
Fig.7
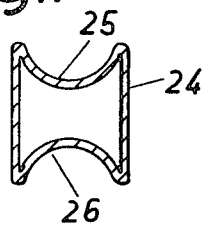
Fig.6
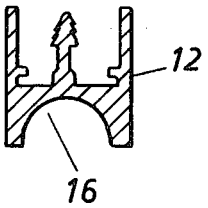

ATTACHMENT FOR WALL CABINETS, MIRRORS, SHELVES AND SIMILAR ARTICLES

BACKGROUND OF THE INVENTION

The subject invention concerns an attachment device to support wall cabinets, mirrors, shelves and similar elements to walls.

The attachment to walls of wall cabinets, mirrors, shelves and similar fittings and elements which are intended to be installed in e.g. bathrooms, is a very difficult and complicated task. Very often, the walls are made of hard concrete, making drilling operations very difficult and time-consuming. This is of course particularly true, when several elements are to be secured to the wall, in which case it is necessary to drill and plug a large number of holes.

When the walls are not made of concrete, conventional gypsum slabs are nowadays used instead. Although drilling is easily performed in such gypsum slabs elements of the kind referred to cannot be safely secured directly to gypsum slabs. In such cases, a special type of attachment screw together with an associated plug therefore must be used which, when inserted through a pre-drilled hole in the slab are secured by parts of the plug and of the screw being pressed against an area around the hole edges on either side of the slab. Obviously, it is a laborious task to attach and arrange a number of such screws and their associated plugs for each element one wants to attach to the wall. Another considerable and important drawback is that the gypsum slabs are in themselves able to support only comparatively light elements. When cabinets, shelves, and similar fittings which must take considerable loads, are to be attached to the wall, such elements must be secured to and supported by the wall cross bars which are placed comparatively large distances apart and thus only in certain places in the walls. This reduces the choice of cabinet sizes, designs and above all, the position of such elements in the room. In addition, the number of heavy elements that can be secured to the cross bars also is reduced, since the number of attachment points in these cross bars is comparatively limited.

A further disadvantage in hitherto known methods of securing wall cabinets, mirrors, and similar elements to walls is that it was often necessary to make a large number of holes in the walls, with the result that considerable damage was done to them, and consequently the walls were quite unsightly when the elements were removed.

The subject invention has for its object to eliminate the problems outlined above by providing means for easy and convenient mounting and attachment to walls of fittings and elements of the kind referred to.

SUMMARY OF THE INVENTION

To achieve this object the invention is characterised in that the attachment device comprises at least two wall strips which are arranged to be attached horizontally to a wall in parallel and opposite relationship and which strips have means thereon arranged to cooperate with means on the element to be attached to the wall, alternatively to cooperate with members arranged to be connected to said element, in that a tongue on said element, alternatively on said connecting member, is arranged for reception in a groove in one of said wall strips, or vice versa, the tongue is formed in the wall strip and the groove in the element, alternatively in the connecting member, in that the other wall strip is provided with a groove, in that for the purpose of cooperation with said other wall strip said connecting member, alternatively said element, is provided with a groove or with controllable snap means, said groove or snap means assuming a position directly opposite and immediately adjacent said groove in the other wall strip when said connecting member or means on the element after application of the element against the wall, are inserted in the space separating the two wall strips, and in that the element is arranged to be locked in the desired position along the wall strips by the snap means sliding into position in the groove in the other wall strip, alternatively by insertion of a locking pin on one side of the element or on both sides thereof into an aperture formed by the groove in the other wall strip and by the groove in said element.

The attachment device in accordance with the invention offers the advantage that the wall strips need to be secured only in a few places, for instance in two wall cross bars. In addition, once the two strips are placed and secured in position, on the wall it is possible in accordance with the teachings of the subject invention to attach a large number of elements to the wall strips in the manner indicated without having to drill holes in the wall, and thus damage the latter.

It might seem obvious to secure strips on the wall and thereafter attach various fittings and elements to the strips, and naturally the idea as such is not novel. However, the problem takes on quite a different aspect and becomes considerably more difficult to solve in the case of attachment of elements that are intended to support comparatively heavy weights and loads. Heavy elements cannot, for obvious reasons, be attached be screwing them directly to the wall strip, since screw holes made in the strips reduce the strip strength and the strips must be of considerable dimensions to be able to support such heavy elements. However, heavy, large wall strips are not aesthetically pleasing but since it is necessary to make holes in the strips in order to secure the elements thereto by screwing, this means that the positions of the individual elements cannot be shifted or altered once they are secured in place, since this would involve an increase of the number of holes made in the wall strips.

Owing to the provisions of the subject invention it is possible to mount elements of various sizes without having to make holes in the wall strips and according to the user's need and wish it is possible to shift and alter the position of the elements along the wall strips whenever required.

BRIEF DESCRIPTION OF THE DRAWINGS

The invention will be described in closer detail in the following with reference to one embodiment thereof illustrated in the accompanying drawings. In the drawings.

FIG. 4 illustrates on an enlarged scale and in a partly broken perspective view a part of the attachment device in accordance with FIGS. 2 and 3, FIGS. 5 and 6 are cross-sectional views of the arrangement of FIG. 4, showing profiled bars arranged to be interconnected by wooden strips, FIG. 7 is a cross-sectional view of a wall strip in the shape of a profiled tube.

DETAILED DESCRIPTION OF A PREFERRED EMBODIMENT

Figure 1:
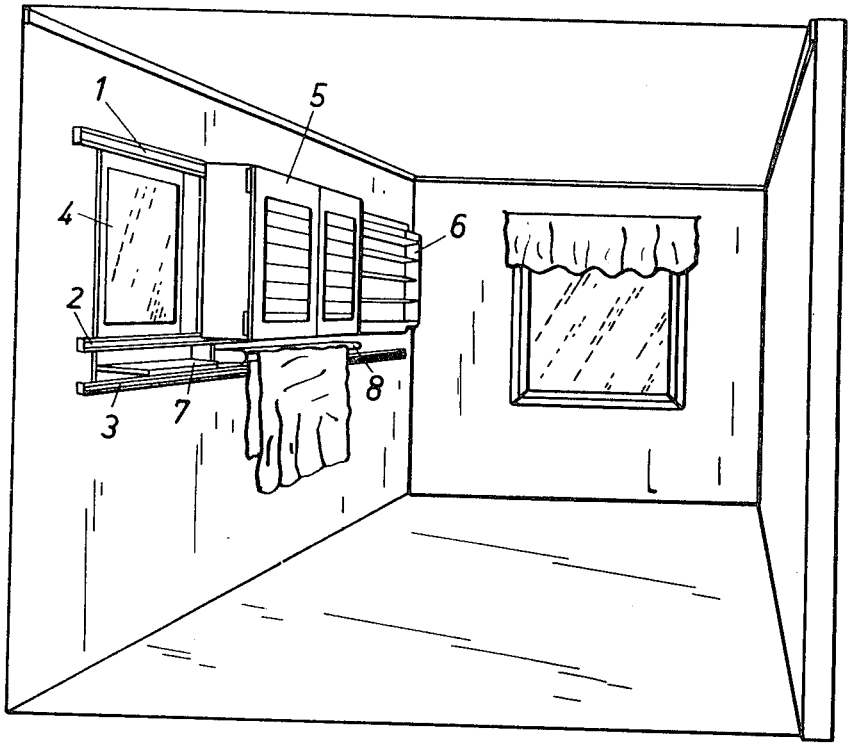
FIG. 1 illustrates a room having bathroom fittings secured on an attachment device in accordance with the invention.

Reference numerals 1, 2, and 3 designate horizontally one above the other arranged wall strips. A mirror 4, a bathroom cabinet 5, and a shelf 6 are positioned between the wall strips 1 and 2 of FIG. 1. The wall strips 2 and 3 support a shelf 7 and a towel rack 8. The mode of attachment of the various fittings and elements to the wall strips is, as will appear from the subsequent description, such as to ensure that the individual elements can be re-arranged in various positions along the wall strips.

Figure 2:
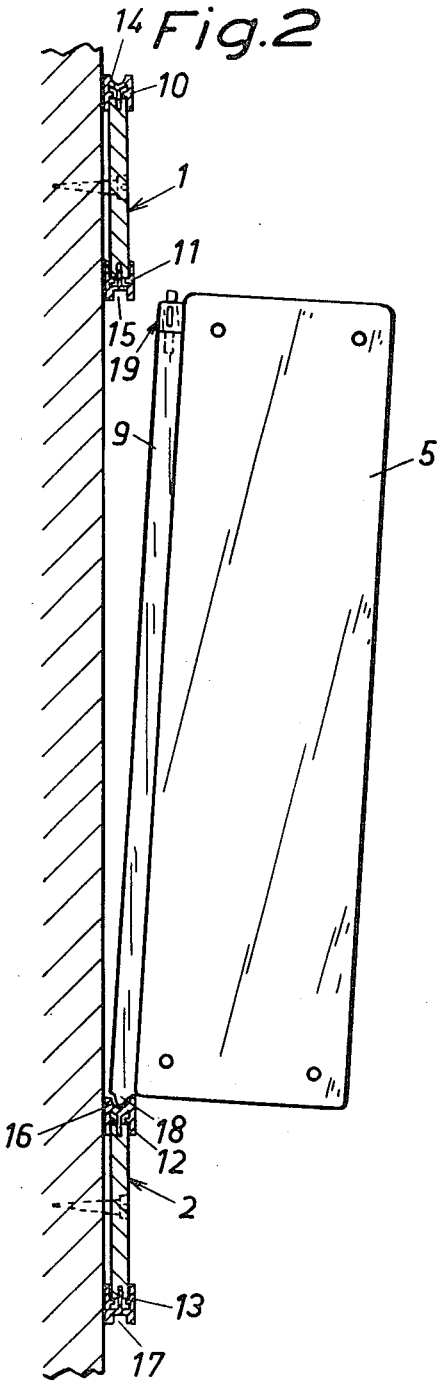
FIGS. 2 and 3 illustrate the manner in which a cabinet is secured to the wall with the aid of the attachment device in accordance with the invention.
Figure 3:
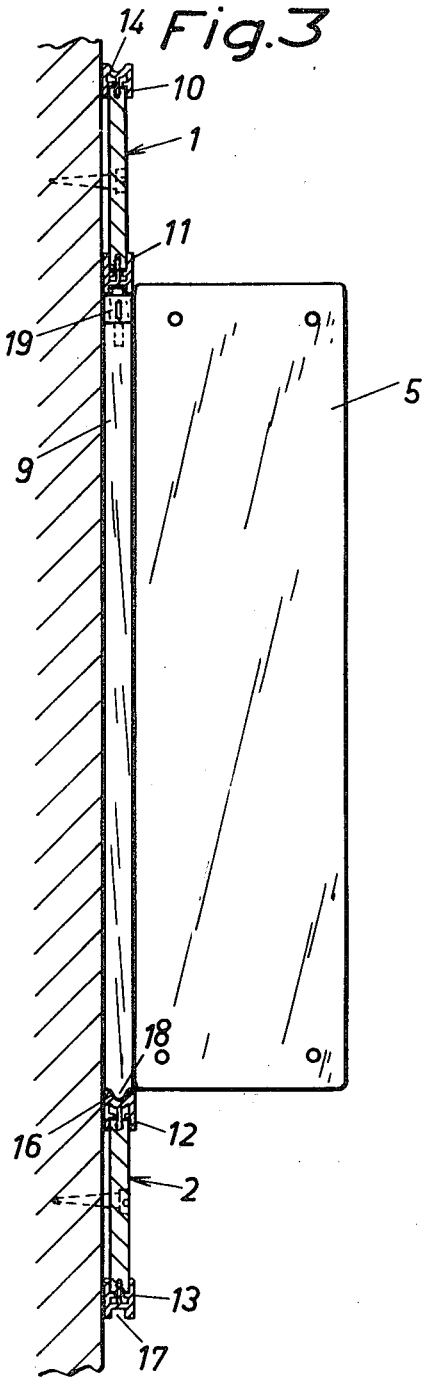

FIGS. 2 and 3 illustrate the manner in which a cabinet 5 is secured between two wall strips 1 and 2. On the rear face of the cabinet 5 are secured two mounting rods, one of which, 9, is illustrated in the drawings. The wall strips 1, 2 consist of wooden bars on the lengthwise (horizontal) edge faces of which are mounted profiled aluminium rods 10, 11, and 12, 13 respectively. Each one of said profiled rods 10, 11, 12, 13 mounted on the edge faces of the wall strips 1, 2 has a groove 14, 15, 16, 17 therein. At their lower ends each mounting rod 9 is formed with a tongue 18 which, as appears from FIG. 2, is inserted in the groove 16, when the cabinet is to be suspended on the wall. At their upper ends, the mounting rods 9 are provided with snap means 19 which are arranged so as to ensure that they will be positioned exactly opposite the groove 15 in the wall strip 1, when the cabinet 5 has been tilted against the wall. The snap means 19 also comprises a movable part 20 arranged to snap into the groove to secure the mounting rods and consequently the cabinet securely in position on the wall strips 1 and 2.

FIG. 4 illustrates on an enlarged scale the design of the wall strips 1, 2 and that of the mounting rods 9. The snap means 19 which is fast with its associated mounting rod 9 consists of a hollow portion 21 and a piston 20, the latter being arranged to project into the interior of the hollow portion 21 against the action of a spring (not shown). When a mounting rod 9 is placed in position between the two wall strips, the piston 20 is forced into portion 21, either manually or with the aid of a tool, and when the piston assumes a position opposite the groove in the profiled bar 11, the piston is released and as a result snaps into the groove. The mounting rods 9 are provided with pre-drilled holes 22, 23 to facilitate the positioning and tightening of attachment screws designed to secure the cabinet.

When the wall strips 1 and 2 are to be attached to the wall it is convenient to use the mounting rods 9 as spacer members to ensure the correct distance between the two horizontal strips. The mounting rods are thereafter removed and are secured to the rear face of the cabinet 5. Initially, the mounting rods are secured only loosely to the cabinet, the screws not being fully tightened. The driving-in of the screws is effected from the interior of the cabinet. After attachment of the cabinet between the two wall strips as described above with reference to FIGS. 2 and 3, the mounting rods 9 are screwed tightly home, this work being effected from the interior of the cabinet as indicated above. The cabinet is now secured also laterally and is able to withstand normal loads and use.

FIGS. 5 and 6 illustrate the profiled bars 11 and 12 in cross-sectional views. The groove 15 in the profiled bar 11 is U-shaped in cross-section, allowing for reception of the piston 20 of the snap means in the groove. The groove 16 of the profiled bar 12 has a semi-circular cross-sectional configuration and matches the shape of the tongue 18 of the mounting rod.

FIG. 7 is a cross-sectional view of a wall strip 24 in accordance with an alternative embodiment. In this case, the strip 24 is in the form of a profiled tube of essentially square configuration, preferably of aluminium, and is provided with lengthwise grooves 25, 26 on two opposite sides. Profiled tubes of this kind are preferably used as a wall rail in positions closest to the floor but of course they can also replace other wall strips.

Figure 8:
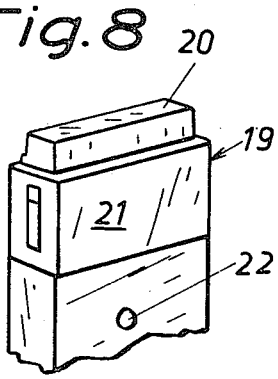
FIGS. 8 and 9 illustrate snap means of the kind incorporated in the attachment device of FIGS. 2 to 4.
Figure 9:
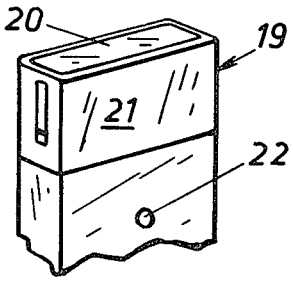

FIGS. 8 and 9 are additional views of the snap means 19. FIG. 8 shows the snap means with the piston 20 in its normal position and FIG. 9 shows the snap means with the piston 20 in its pushed-in position.

Figure 10:
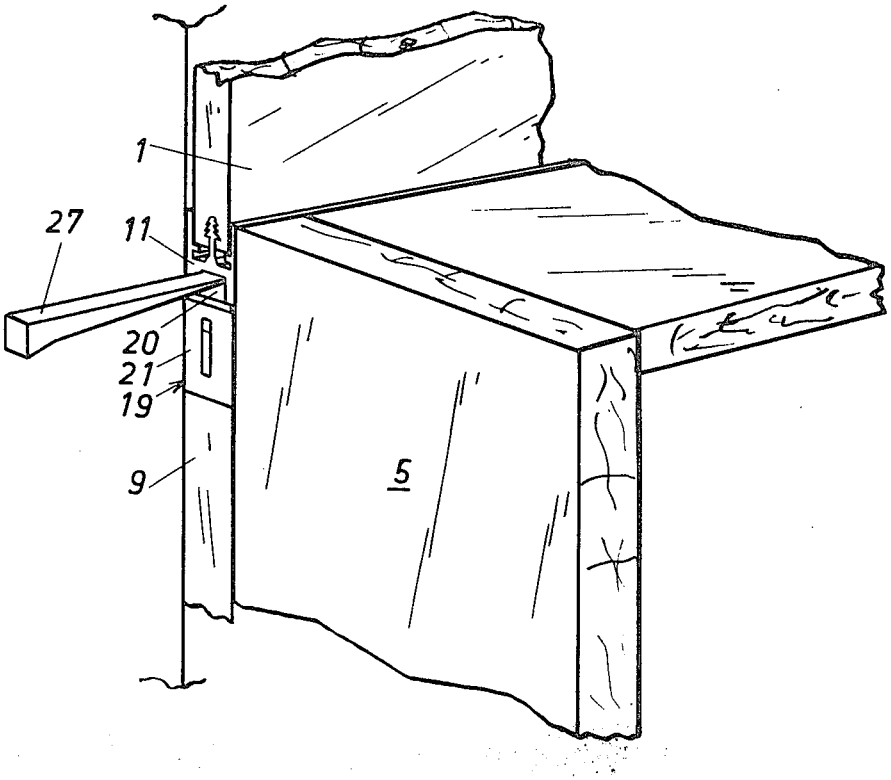
FIG. 10 illustrates the manner in which the snap means of FIGS. 8 and 9 can be disengaged from their associated wooden strip.

FIG. 10 illustrates the manner in which the mounting rods 9 are detached from the wall strip 1. A dismantling wedge 27 is forced in between the piston 20 and the bottom of the groove 15. When the piston is in its fully pushed home position, the cabinet can be lifted from the wall.

Before the dismantling wedge is inserted as described, the screws which connected the cabinet with the mounting rods, are unscrewed over a few turns to untighten them slightly.

When other elements are mounted on either side of the cabinet it is not possible to use dismantling wedges. In such cases it is necessary to unscrew the cabinet completely from the mounting rods.

Figure 11:
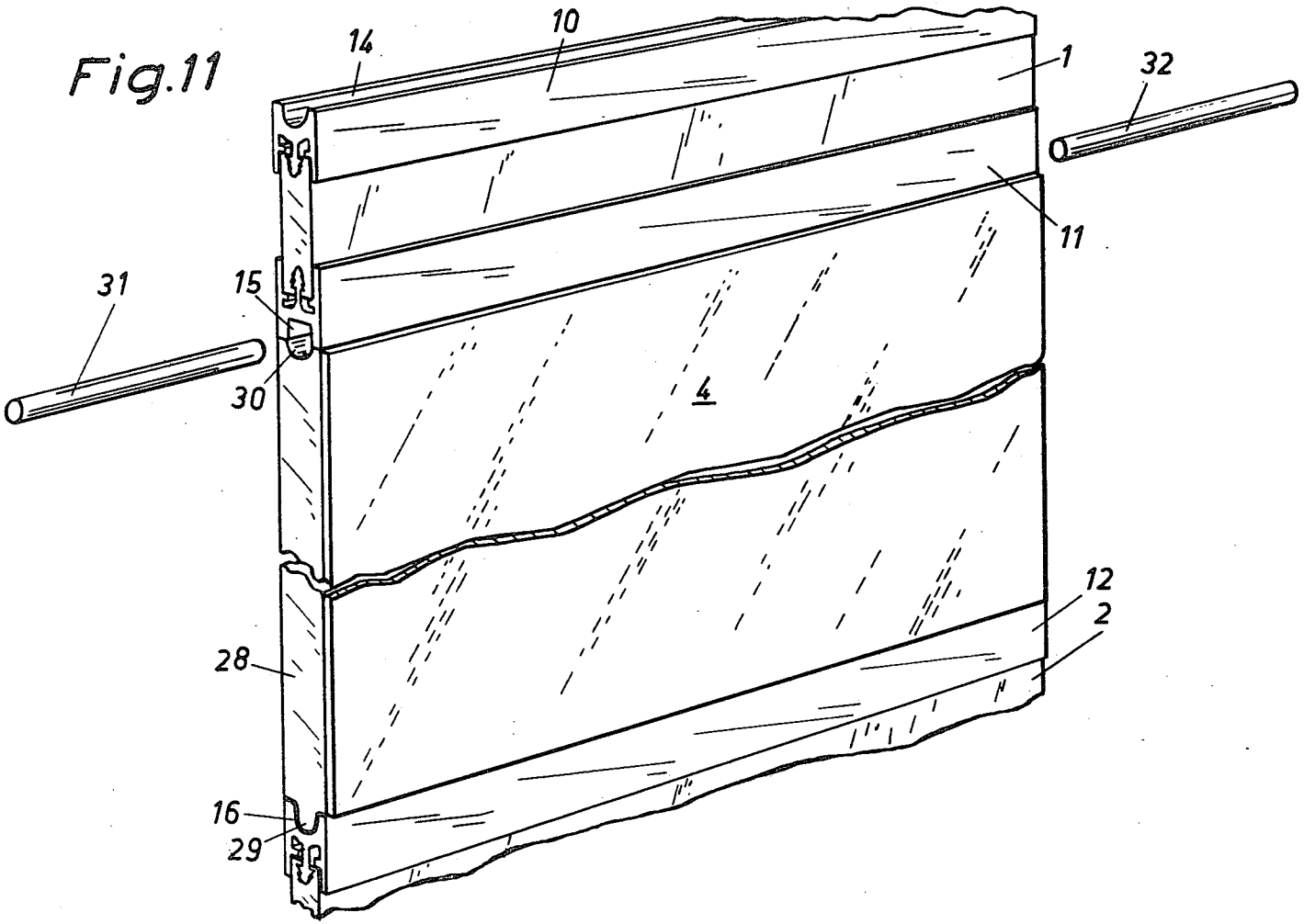
FIG. 11 shows a modified embodiment of the attachment device in accordance with the invention.

FIG. 11 shows an alternative embodiment of the attachment device in accordance with the invention. The wall strips 1 and 2 are identical with those described with reference to FIGS. 1 to 10. The mirror 4 is not attached to and mounted with the aid of mounting rods; instead the plate 28 to which the mirror glass is secured, is provided at its bottom edge with a tongue 29 matching the groove 16 formed in the lower strip 2. At its upper edge the plate 28 is provided with a groove 30 and when the mirror is pressed against the wall, this groove will be positioned exactly opposite the groove 15 formed in the upper wall strip. The mirror is locked in the desired position with the aid of locking pins 31, 32 which are inserted in the aperture formed by the groove 29 in the plate and by the groove in the wall strip 1 and which pins, when applied in position, securingly clamp the mirror in position in the space between the wall strips.

The invention is not limited to the embodiments described above and illustrated in the drawings but a number of variations are possible within the scope of the appended claims.

In the aforegoing has been described with reference to FIGS. 2 to 11 merely the manner in which a cabinet and a mirror may be secured between the two horizontal wall strips. Other fittings and elements, such as shelves, towel racks and hangers are mounted and secured in the same manner, viz. with the aid of either mounting rods or locking pins. The invention provides the use of a certain modul system of the elements to be attached between the strips, i.e. one element may be exchanged and replaced for another one.

What I claim is:

1. An improved attachment device to carry wall cabinets, mirrors, shelves and similar elements, the improvement comprising at least two wall strips arranged to be attached horizontally to a wall in parallel and opposite relationship, attachment means formed on each of said strips and cooperating attachment means formed on opposite upper and lower ends of element intended to be attached to the wall, said means on said strips each being arranged to cooperate with respective of said attachment means on said element, the attachment means on one of said strips and one end of said element comprising cooperating tongue and groove parts for connecting each one strip and said element together the attachment means of the other of said wall strips comprising a groove formed in the other wall strip, the attachment means of the other end of said element including a releasable locking means operable in the locked position to cooperate with the groove of said other wall strip said element arranged to be locked in the desired position along said wall strips by movement of said releasable locking means into its locked position in its associated groove in said other wall strip.

2. An improved attachment device as claimed in claim 1 wherein said elements include a pair of mounting rods, each rod provided at its one end the tongue and groove connection with the one of said wall strips and wherein said releasable locking means comprise pistons slidably supported by the other ends of said rods and arranged to be depressed to their released position against the action of springs.

3. An improved attachment device as claimed in claim 1, wherein said wall strips are wooden rails and include at least one profiled bars affixed on one lengthwise face of said strip, said profiled bar being of aluminium and shaped so as to form respectively said tongue and groove.

4. An improved attachment device as claimed in claim 1, wherein at least one of said wall strips consists of a profiled tubes shaped on one sides to form said tongue and grooves connection.

5. An improved attachment device as set forth in claim 2 wherein the tongue and groove connection comprises a groove formed in the one locking strip and tongues formed on the one end of the mounting rods.

6. An improved attachment device as set forth in claim 1 wherein the attaching means between the other end of the element and the other of the wall strips comprises grooves formed in said other locking strip and in said other end of said element, the releasable locking means comprising a rod complimentary in shape to said groove and insertable therein.

* * * * *